US011576444B2

(12) United States Patent
Agarwal et al.

(10) Patent No.: US 11,576,444 B2
(45) Date of Patent: Feb. 14, 2023

(54) REFLECTIVE FABRICS

(71) Applicant: The H.D. Lee Company, Inc., Greensboro, NC (US)

(72) Inventors: Dhruv Agarwal, Greensboro, NC (US); Josue Monge, Greensboro, NC (US); Samuel Beagle, Reidsville, NC (US)

(73) Assignee: The H.D. Lee Company, Inc., Greensboro, NC (US)

( * ) Notice: Subject to any disclaimer, the term of this patent is extended or adjusted under 35 U.S.C. 154(b) by 868 days.

(21) Appl. No.: 16/183,596

(22) Filed: Nov. 7, 2018

(65) Prior Publication Data

US 2019/0133218 A1 May 9, 2019

Related U.S. Application Data

(60) Provisional application No. 62/583,308, filed on Nov. 8, 2017.

(51) Int. Cl.

| | |
|---|---|
| ***D03D 13/00*** | (2006.01) |
| ***A41D 13/01*** | (2006.01) |
| ***D03D 1/00*** | (2006.01) |
| ***D06M 15/564*** | (2006.01) |
| ***D06M 15/263*** | (2006.01) |

(Continued)

(52) U.S. Cl.

CPC ..... *A41D 13/01* (2013.01); *A41D 31/32* (2019.02); *D02G 3/346* (2013.01); *D03D 1/00* (2013.01); *D03D 13/004* (2013.01); *D03D 15/54* (2021.01); *D06M 15/263* (2013.01); *D06M 15/564* (2013.01); *D06P 1/004* (2013.01); *D06P 3/24* (2013.01); *D06P 3/34* (2013.01);

(Continued)

(58) Field of Classification Search

CPC .. B29D 11/00865; D03D 1/00; D03D 13/004; D06M 15/263; D06M 15/564; D06P 3/24

USPC ..... 427/162–169

See application file for complete search history.

(56) References Cited

U.S. PATENT DOCUMENTS 7,175,901 B1 * 2/2007 Sagar ..... C03C 17/36 106/31.13
8,033,671 B1 * 10/2011 Nilsen ..... G02B 5/124 359/529

(Continued)

FOREIGN PATENT DOCUMENTS

DE 202012004624 U1 10/2013
JP 2006249646 A 9/2006

(Continued)

OTHER PUBLICATIONS

European Patent Office, International Search Report and Written Opinion of the International Searching Authority in PCT/US2018/059677, dated Jun. 3, 2019, 12 pages.

*Primary Examiner* — Elizabeth A Burkhart

(74) *Attorney, Agent, or Firm* — Womble Bond Dickinson (US) LLP

(57) ABSTRACT

Disclosed is a retro-reflective fabric, having an inner surface and an outer surface; one or more strands of retro-reflective yarn incorporated into the fabric; and a reflective ink coupled to the outer surface of the fabric. Also provided is a method of making a retro-reflective fabric, including: providing a coated retro-reflective yarn; incorporating the coated retro-reflective yarn into the weave or knit of a fabric; and disposing a reflective ink into an outward facing surface of the fabric.

24 Claims, 5 Drawing Sheets

(51) Int. Cl.

| | |
|---|---|
| ***D06P 1/00*** | (2006.01) |
| ***D06P 3/34*** | (2006.01) |
| ***D06P 3/24*** | (2006.01) |
| ***D02G 3/34*** | (2006.01) |
| ***A41D 31/32*** | (2019.01) |
| ***D03D 15/54*** | (2021.01) |
| *A41D 1/089* | (2018.01) |

(52) U.S. Cl.
CPC ..... *A41D 1/089* (2018.01); *A41D 2500/20* (2013.01); *D10B 2401/20* (2013.01); *D10B 2501/04* (2013.01)

(56) References Cited

U.S. PATENT DOCUMENTS

| | | | | |
|---|---|---|---|---|
| 2006/0139754 | A1* | 6/2006 | Bacon | G02B 5/124 359/530 |
| 2010/0005601 | A1* | 1/2010 | Kantor | C09D 7/70 106/287.23 |
| 2015/0168614 | A1* | 6/2015 | Running | G02B 5/124 359/530 |
| 2016/0299269 | A1 | 10/2016 | Parmanen et al. | |
| 2018/0237961 | A1* | 8/2018 | Kwon | D03D 15/54 |

FOREIGN PATENT DOCUMENTS

| | | | |
|---|---|---|---|
| WO | 2011156930 | A1 | 12/2011 |
| WO | 2016174492 | A1 | 11/2016 |

* cited by examiner

REFLECTIVE FABRICS

CROSS REFERENCE TO RELATED APPLICATION

This application claims the benefit of U.S. Patent Application No. 62/583,308 filed on Nov. 8, 2017, which is hereby incorporated by reference in its entirety.

FIELD

This disclosure relates to light reflective fabrics and garments made from the same. In particular, this disclosure relates to fabrics that incorporate light reflective yarns and invisible light reflective printing.

BACKGROUND

The placement of glass beads upon a surface to create a retro-reflective surface has been conventionally employed for some time. In general, glass beads are adhered to a reflective surface and act as a lens for transmission and reflection of incident light. Typically, the retro-reflective surfaces compose a tape or applique that is coupled or otherwise adhered to the surface of a garment. While many articles of clothing are required to meet the ANSI/ISEA-107 standard guidelines for worker safety, there are other, "safety-related," products in the market that are not required to meet the ANSI/ISEA-107 standard. These types of garments typically contain reflective trims, tapes, and logos, strategically placed onto the garment/fabric background. Most of these products are tuned to the athleisure/active-wear space with little application/use in everyday garments (for example, office/business casual-, commuter-, and work-wear).

Other approaches to retro-reflective garments include the incorporation of retro-reflective tapes into the weave of a fabric and printing of reflective inks into the outward facing surface of a garment. Yarns containing retro-reflective technology have been produced for incorporation into garments. These retro-reflective yarns are typically made by converting/slitting 3M Scotchlite™ reflective and the like tapes into very fine/narrow yarns. These tape based yarns are either woven or knitted to make a reflective fabric, for example as either a neat form or plied with another yarn to reinforce the brittle reflective tape yarn. The reflective ink application containing retro-reflective technology is referred to as reflective visible print. The visible prints are mostly grey/silver in color and recent developments have incorporated the use of color in these reflective inks, at the expense of reflective performance. As in many coatings applied on fabrics, reflective inks can restrict the airflow wherever treated.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

FIG. 2A is an example of twill reflective fabric under ambient light conditions and FIG. 2B the same fabric under photographic flash. FIG. 2C is a ripstop design modified for reflective stealth integration.

FIG. 3A is a khaki twill with a Roma vector pattern using a reflective ink under ambient light conditions and FIG. 3B under photographic flash. FIG. 3C is another twill fabric treated with reflective ink under ambient light conditions and FIG. 3D photographic flash, but with a significantly lighter coating for lighter hand-feel.

FIG. 4A is a denim reflective fabric under ambient light conditions and FIG. 4B under photographic flash.

DETAILED DESCRIPTION OF DISCLOSED EMBODIMENTS

Figure 1:
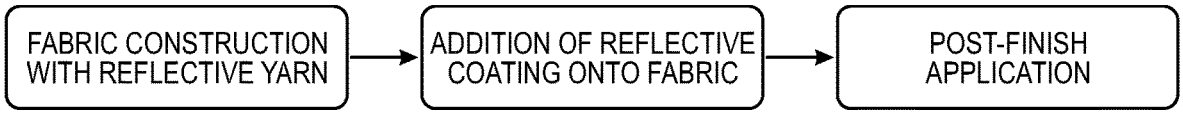
FIG. 1 is flow chart of the manufacturing process for a retro-reflective fabric.

In the following detailed description, reference is made to the accompanying drawings, which form a part hereof, and in which are shown by way of illustration embodiments that is practiced. It is to be understood that other embodiments is utilized and structural or logical changes is made without departing from the scope. Therefore, the following detailed description is not to be taken in a limiting sense, and the scope of embodiments is defined by the appended claims and their equivalents.

Various operations are described as multiple discrete operations in turn, in a manner that is helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, is used. It should be understood that these terms are not intended as synonyms for each other. Rather, in particular embodiments, "connected" is used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Introduction

Thousands of pedestrians are killed and injured in night-time traffic accidents annually. Reflective and, in particular, retro-reflective clothing enhances the visibility of the wearer when contacted by an incident light beat for example from headlights of alp oncoming vehicle. The incorporation of retro-reflective materials into everyday wear, such as jeans, coats and other clothing, would greatly improve nighttime safety in urban and suburban environments. It is without question that garments incorporating retro-reflective technology would save lives. However, the implementation of this technology has thus far been limited because retro-reflective technology does not typically lend itself to fashionable attire. The present disclosure meets the safety concerns discussed above without compromising the aesthetics of the fabric and a garment made therefrom.

Disclosed herein are retro-reflective fabrics and garments incorporating such fabrics in which the retro-reflective technology is stealthily integrated. As disclosed herein, uniquely engineered reflective yarns are incorporated into garments during the fabric construction processes, such as during the weaving, knitting, embroidery, etc. process. These retro-reflective yarns are camouflaged into the garment so that there is little or no change in the aesthetics of the garment over a garment without the integrated retro-reflective technology. Therefore, the disclosed fabrics can be used in fashionable everyday wear without sacrificing the aesthetic appeal of the garment.

The incorporation of retro-reflective yarn into fabric coupled with invisible reflective print ink creates an aesthetically pleasing fabric in which the retro-reflective properties are camouflaged and embedded into the fabric's color background. By using a limited amount of a retro-reflective yarn the visual characteristics of the yarn do not dominate the fabric in typical daylight or ambient light conditions. Similarly, by using invisible printing reflective technology in combination with the retro-reflective yarn, the reflectivity performance is synergistically enhanced allowing less reflective print than otherwise required. The result is that the performance, such as breathability, drape, texture, moisture transmission, and/or feel of the fabric is not adversely effected by the reflective ink or coating. In addition, by using a disclosed encapsulated retro-reflective yarn, the durability of the reflective aspects of any garment produced is vastly improved over a garment that does not use an encapsulated retro-reflective yarn. As disclosed herein, this improved durability does not affect reflectivity but enhances durability to chemicals and abrasion. Furthermore, post-finish applications, such as durable water repellent (DWR), anti-microbial coatings or treatments, softening agent treatments, for example to soften garments, abrasion resistant finishes or coatings, anti-bacterial coatings or treatments, odor reduction coatings or treatments, and the like, can be applied after reflective treatment, which further improves both the durability and effectiveness of the retro-reflective application. A generalized schematic of the manufacturing process is shown in FIG. 1.

Retro-Reflective Fabric and Garments

The present disclosure relates to retro-reflective fabrics, yarns, and garments and other articles made from such yarns and fabrics. A difficulty in using retro-reflective yarn is its high cost to manufacture and its abrasive characteristics; to both end-user (in garment form) and metal parts used in both fabric and garment manufacturing processes, if used in large quantities (e.g., 100% in fabric). As disclosed herein, the inventors have solved this and other problems by incorporating uniquely engineered retro-reflective yarns during fabric construction (e.g., weaving, knitting, embroidery, etc.) utilizing fabric designs for stealth integration of retro-reflective technology. As disclosed herein, the stealthy integration of a retro-reflective yarn means that the entire fabric is not made from retro-reflective yarn, but instead introduced strategically into the fabric so that in daylight or ambient light situations the yarn is not readily detectable (see, for example, FIGS. 2A-2B). The uniquely engineered reflective yarn disclosed herein provides the strength needed for the reflective tape yarn to survive the stress yarns undergo through the fabric manufacturing process. Retro-reflective yarns, including those described herein, are woven, knitted or otherwise incorporated to produce a fabric in a conventional manner, such as those that would be understood by a person of ordinary skill in the art. For a woven fabric, the density of retro-reflective yarn can vary from maximum of either every pick or weft, to every alternate pick, or even about every ten inches and any value therebetween. In certain working examples, the density of retro-reflective yarn was about every inch, about every two inches, and about every three inches. In addition, in some embodiments, such as is a ripstop fabric, multiple strands of retro-reflective yarn can be inserted at the same position in the fabric, for example two picks of retro-reflective yarn can be inserted at the same time, or more than two picks of retro-reflective yarn can be inserted at the same time, to enhance strength and/or reflectivity. As disclosed herein a retro-reflective yarn, such as disclosed herein, is incorporated into a fabric during construction, such as weaving, knitting, embroidery, etc. of the fabric. For example, in a woven fabric the retro-reflective yarn is woven using a plain weave (such as, a 1 by 1 plain weave, a rib weave, and the like), a mat weave, a twill weave, a satin weave, an oxford weave, a ripstop weave, and the like. In certain embodiments, the retro-reflective yarn is placed at regular, or irregular positions within the fabric. For example, in certain woven embodiments, the retro-reflective yarn not placed at every weft and/or warp position, and can be integrated at regular or even irregular intervals during the weaving process, such as at regular or even irregular intervals in the weft and/or the warp. In some embodiments, the fabric comprises weft yarns and warp yarns. In embodiments, the retro-reflective yarn is used in the weft yarns, the warp yarns, or both. In some embodiments, the retro-reflective yarn is used in only the weft yarns or the warp yarns, but not both.

Figure 2C:
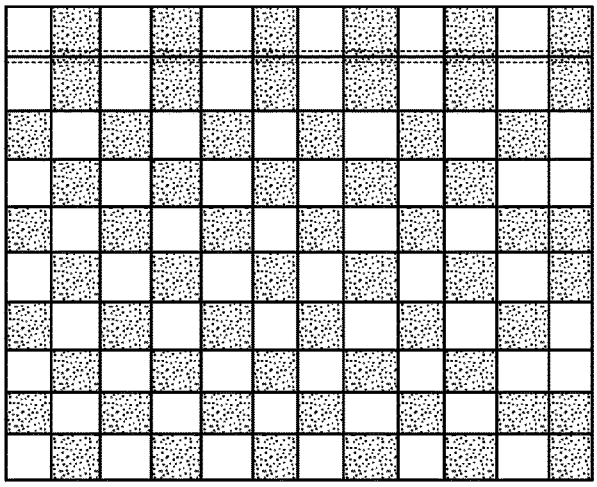
FIGS. 2A-2C illustrate sample garments designed and constructed using engineered retro-reflective yarn and a ripstop design.
Figure 2B:
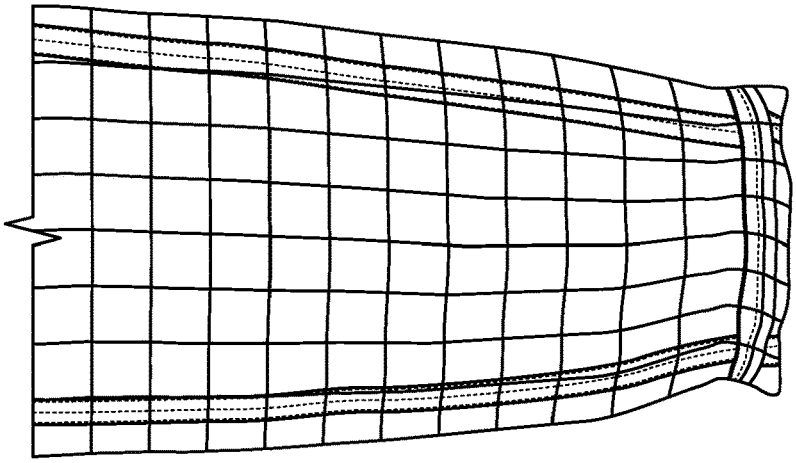
Figure 2A:
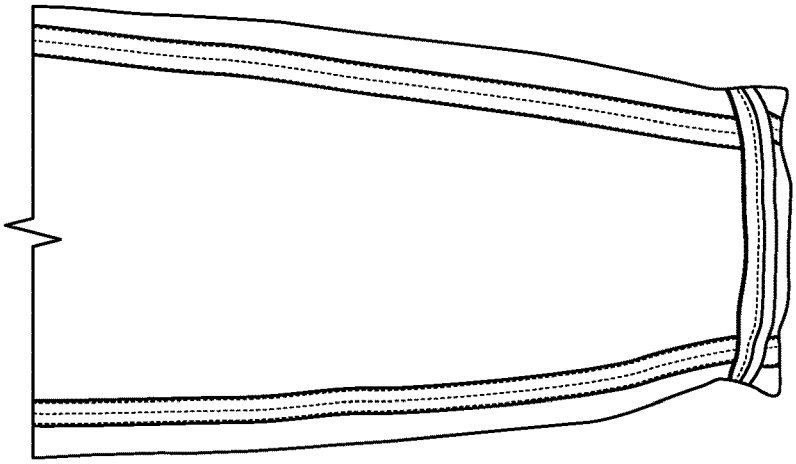
Figure 3A:
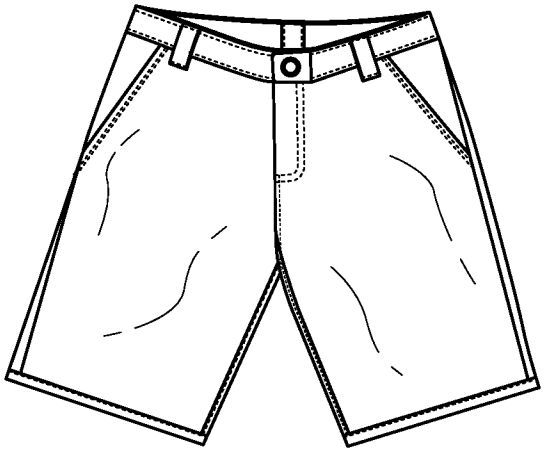
FIGS. 3A-3D illustrate sample garments designed and constructed using visible reflective print.
Figure 3B:
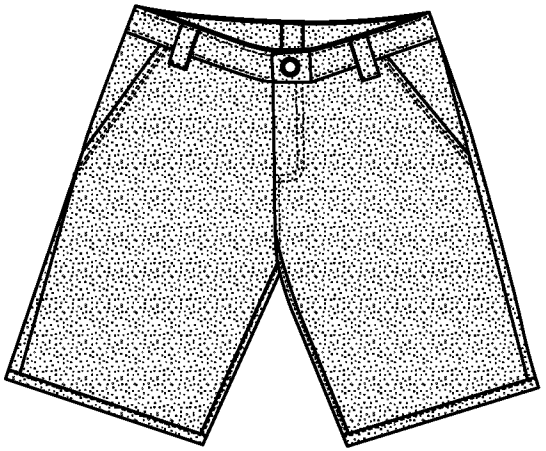
Figure 3C:
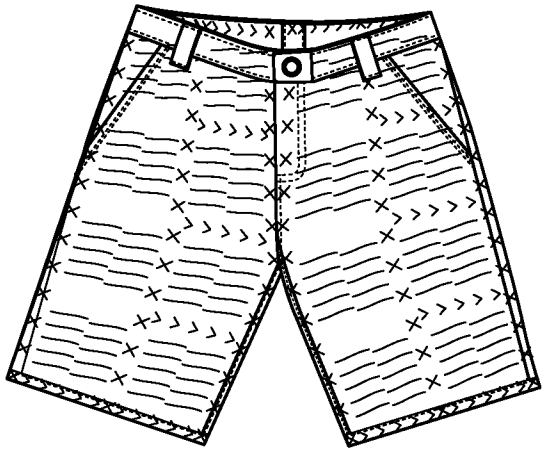
Figure 3D:
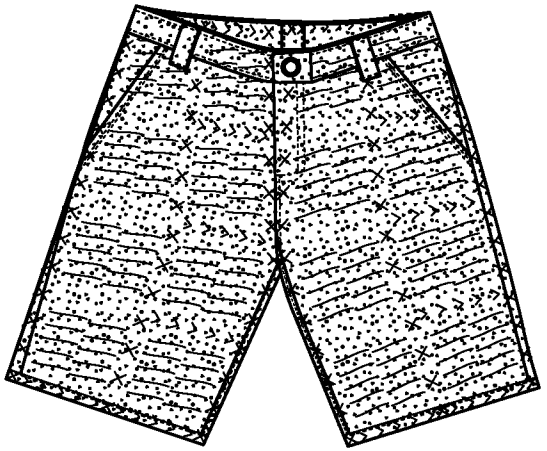
Figure 4B:
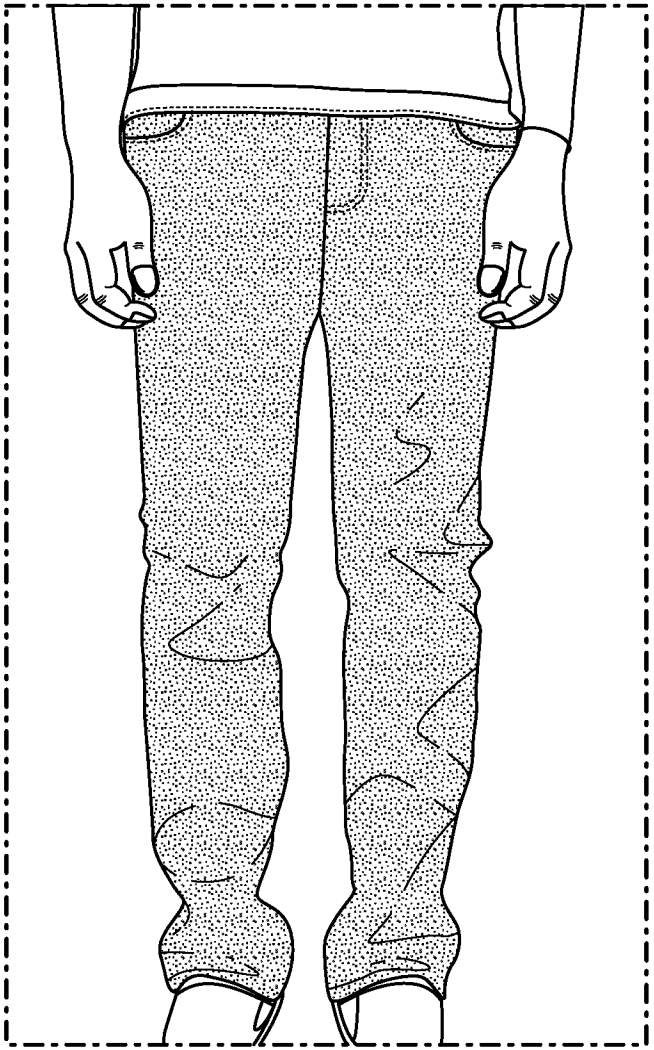
FIGS. 4A and 4B illustrate sample garments designed and constructed using invisible reflective print.
Figure 4A:
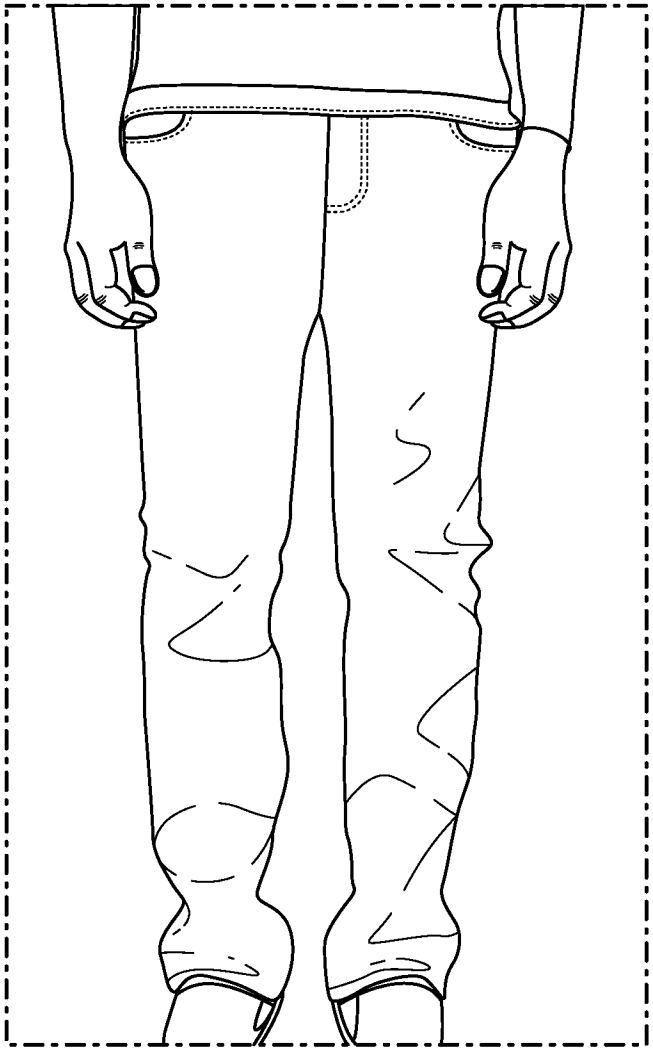

In certain embodiments, the retro-reflective yarn can be placed at every rip-stop, in an alternating pattern in rip-stop fabrics, and/or in the weft direction (see, for example, FIG. 2C). The one of the warp yarns and the weft yarns that does not comprise the yarn incorporating the retro-reflective yarn comprises a conventional yarn. In certain embodiments, the fabric designs for stealth integration of retro-reflective technology by placement of retro-reflective yarns at every rip-stop or in an alternating pattern in rip-stop fabrics. In certain embodiments, the retro-reflective is placed in the weft-direction, for example at every pick or in an alternating pattern, for example in a denim or twill. The retro-reflective yarn can also be integrated into a knitted fabric. Alternatively, the retro-reflective yarns are used to prepare non-woven fabrics and/or knit fabrics. After weaving, the most prevalent method of fabric construction is knitting, and the retro-reflective yarn can also be integrated, for example, as the wale and/or the course.

In embodiments, the percentage of retro-reflective yarn in a fabric is between about 5% and about 50% of the final fabric, such as about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or about 50% of the final fabric. For example, if both warp and weft include retro-reflective yarns, the range varies from about 8% to about 50% of the final fabric, such as about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or about 50% of the final fabric. In another example, if the retro-reflective yarn is only incorporated in the warp or the weft the range varies from about 5% to about 30% of the final fabric, such as about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, and about 30% of the final fabric.

In certain embodiments, the retro-reflective yarn is a coated yarn, such as disclosed below. In embodiments, the coating is formed by embedding retro-reflective yarn within polyurethane and/or an acrylate, thermoset or thermoplastic preserving its retro-reflective property. In certain embodiments, the process provides abrasion, heat resistance and low light/night time visibility.

As used herein fabric refers to any textile material made through weaving, knitting, braiding or plaiting and bonding of fibers. The retro-reflective yarns can be used with other conventional yarns or fibers to produce a fabric, such as but not limited to natural fabrics including: cashmeres; cottons; hemp; jutes; linens; silks; wools; synthetic or man-made fabrics including: acetates; acrylics; denims; nylons; polyesters; rayons; and the like.

Retro-reflective yarns, such as those described herein, are incorporated into a variety of fabrics that is used in, for example, the manufacture of garments, such as: pants, including jeans, slacks, short-pants, suit pants; dresses; skits; tops, including dress or casual shirts, blouses, jackets, coats; active-wear; gloves; hats and any other worn body wear. The fabrics can also be incorporated into other articles, such as backpacks, sleeping bags, and tents among others.

Reflective Ink Printing

As disclosed herein, in embodiments a retro-reflective fabric includes printing on reflective invisible ink or paint, for example a passively reflective ink, a retro-reflective ink, or a combination thereof, onto the outward facing surface of the fabric, for example, the surface of the fabric that would face outward when the fabric is incorporated into final article, such as an article of clothing when the article of clothing is worn on the body. This application adds an element of stealth and all-over coverage to the reflective garment. The "invisible" nature of the ink is that it is not readily apparent, or visible during daytime and/or ambient light conditions. In other words, a fabric treated or printed with reflective ink or paint is not visible to the human eye until treated fabric is illuminated; see, for example, FIGS. 3A-3D. In some embodiments, the surface of the fabric remains untreated prior to deposition of the reflective ink. For example, to optimize the application in denim, the substrate/fabric remains unfinished (for example, no softener or chemical textile finish is added to the fabric). Alternatively, the addition of a preparatory cleaning or pre-treatment step can also improve technology retention. Thus, in certain embodiments, the chemical make-up of the surface of the fabric is modified and/or treated prior to deposition of the retro-reflective ink, as the surface of the fabric greatly influences the performance and durability of the application. The disclosed retro-reflective fabrics are made by printing or coating on to a fabric a reflective ink or coating, for example by digital printing, screen printing, and/or gravure printing. In some embodiments, the ink coating contains retro-reflective elements, such as microbeads or prisms. In some embodiments, the ink coating contains passive reflective elements, such as that the reflected light is not directed back to the incident source. One of the problems with coating or printing a fabric is that the aesthetics as well as the performance, such as breathability, moisture transfer, etc. of the fabric can be compromised. By limiting the coating and/or printing of the reflective ink, these elements of the fabric, such as aesthetic and/or performance can be maintained. Thus, in certain embodiments, the breathability of the fabric is maintained, for example by limiting the amount and or placement of the reflective ink constituents. The term "breathable" referring to the ability of the fabric to allow the passage of air or other gases of moisture to pass through the fabric. In certain embodiments, the fabric may be one which has moisture management properties. For example, the fabric may be intended to moisture away from its internal surface (for instance, a surface which may contact the skin of the wearer) by a r mechanism such as a wicking action. The fabric may also permit rapid or gradual migration of moisture to the outer surface of the fabric in a controlled manner where evaporation will occur. The result of such moisture management is to keep the internal surface of the fabric substantially dry. In certain embodiments the moisture management properties of the fabric is maintained, for example by limiting the amount and or placement of the reflective ink constituents.

For example the printing or coating may be applied in a continuous or non-continuous pattern, for example, a dot pattern By a "dot pattern" is meant that the print or coating is applied in a pattern of dots, circular, square, rectangular, triangular or other shaped dots separated by blank areas, while by a "reverse dot pattern" is meant that the printing or coating surrounds circular, square, rectangular, triangular or other shaped blank dots. This kind of printing or coating is in effect "solid", but leaves uncoated areas, which enable the fabric to "breathe" and/or allow moisture management.

In embodiments, the reflective printing covers at least about 5%, e.g., at least about 10% and typically at least about 30%, of the exterior facing surface of the fabric. In embodiments, the reflective printing covers up to at least about 95%, e.g., at least up to about 90% and typically up to about 85%, of said pattern area. For example, in some embodiments, the reflective printing covers greater than 50% of the exterior facing surface of the fabric, such as between 50% to 95%, between 60% to 90%, between 70% to 80%, such as, 50%, 55%, 60%, 70%, 75%, 80%, 85%, 90%, or 95%. Alternatively, at least 60%, at least 65%, at least 70%, at least 75% or at least 80% of the reflective printing covers the exterior facing surface of the fabric. In some embodiments, the reflective printing can be uniform or not. In some examples, the reflective printing is applied at a higher density in areas likely encounter incident light, such as the torso, and at lower densities in areas less likely to encounter incident light, such as the underarms of a shirt or jacket In certain embodiments, the ink is brushed, rolled, and/or sprayed on as opposed to printed. Staying and/or brushing of the ink has certain advantages in ease of application over printing technologies. In certain embodiments, a mask is used during the spraying, rolling and/or brushing application to limit the coverage. The fabric may be configured to provide for enhanced air permeability during the weaving process, such as through the control of the density of the warp, e.g. the number of warp ends per inch in the loom.

In some embodiments, such as where the retro-reflective yarn is used in a denim fabric, the density of the warp may be controlled to provide an enhanced air permeability while at the same time maintaining the performance and appearance of conventional denim. For example, the denim fabric on the loom may comprise between about 45 and about 120 warp ends per inch, alternatively between about 45 and about 100 warp ends per inch, alternatively between about 50 and about 80 warp ends per inch, alternatively between about 55 and about 75 warp ends per inch.

Embodiments of the fabric produced in accordance with the present disclosure may be characterized by a number of properties. One such property is the permeability index, or $i_m$ value. The permeability index represents the effect of skin moisture on heat loss, as in the case of a sweating skin condition. The permeability index measures moisture-heat permeability through a fabric on a scale of 0, which indicates that the fabric is completely impermeable, to 1, which indicates that the fabric is completely permeable.

The permeability index may be determined using a standard test method, as specified in ASTM F1868 part C, using a sweating hot plate. This test may be generally referred to as a sweating hot plate test. A sweating hot plate test provides an assessment of heat and moisture (vapor) transport through the fabric into a controlled environment. As such, the sweating hot plate test relates to the thermal resistance (insulation) of a fabric, the evaporative resistance (breathability/permeability) of a fabric, and the total heat loss from the plate through the fabric into the environment.

Reflective Yarn Encapsulation

Aspects of the current disclosure concern the encapsulation of reflective yarns to increase the durability and thus retention of the retro-reflective elements on or within the retro-reflective yarns. One of the problems of retro-reflective yarns and/or tapes presently available is that the reflective elements, such as glass beads, are prone to abrasion and erosion at the edges of the yarns and subsequent loss of the retro-reflective qualities of the yarn/tape and the garments they are part of. To overcome this problem the inventors have developed a cost effective way to "lock" the retro-reflective elements to the yarn/tape, which increases the reflective life time of the garments and consumer confidence in the product. In various embodiments, the encapsulation method involves coating the raw retro-reflective yarn with one or more coating agents. Embodiments of the present disclosure are directed toward one or more yarns that include a polymer, such as a thermoset coating a retro-reflective yarn. In certain embodiments, the polymer is any thermoset polymer that is configured for use in a fabric, such as a wearable fabric. In some embodiments, the polymer includes one or more functional polyurethanes and/or acrylates.

In certain embodiments, the retro-reflective yarns is encapsulated within a coating of functional polyurethane, such as one or more functional polyurethanes, and/or functional acrylate, such as one or more functional acrylates. In certain embodiments, the functional polyurethanes include one or more mono, di and/r tri functional polyurethanes. In certain embodiments, the functional acrylates include one or more mono, di, tri, and/or multifunctional acrylates. In certain examples an acrylate monomers is a mono, di, tri or multifunctional acrylate, such as isobornyl acrylate. In certain embodiments, the coating agent includes an aliphatic urethane acrylate such as the difunctional aliphatic urethane acrylate oligomer SU 5347 from SOLTECH. In certain embodiments, the coating agent includes a carboxyfunctional polyester acrylate such as the carboxyfunctional polyester acrylate Genomer 7151 from RAHN.

In certain embodiments, the one or more functional polyurethanes, and/or one or more functional acrylates are cured by application of an appropriate radiation source. The radiation source can be selected based on the specific chemical entities used for the coating agent. In certain embodiment, the radiation source includes a UV radiation source. In certain embodiment, the radiation source includes an IR radiation source. In an example of UV curable chemistry—there are major four components—monomer, oligomer, additive and photoinitiator. Oligomers typically are selected form aliphatic or aromatic urethanes because of their good flexibility for garment applications. Suitable coating materials are commercially available, such as from Sartomer, BASF, RAHN, MIWON, Henkel, etc. In certain embodiments, the coating material includes a functional acrylate, such as methacrylates including aromatic urethanes, aliphatic urethanes as oligomers. In certain embodiments, the coating agent includes monomers such as mono, di, tri and multifunctional acrylates that are good for flexibility, adhesion to plastics and abrasion resistance. By way of non-limiting examples, exemplary products are available from Miwon (see, for example, Miramer SC2404, an aliphatic difunctional acrylate; Miramer U307, an aliphatic difunctional acrylate oligomer; Miramer M140, a phenol (EO) acrylate monomer; and/or Miramer M244, a bisphenol A (EO)3 diacrylate monofunctional or difunctional acrylate).

In certain embodiments, a retro-reflective yarn, such a commercially available retro-reflective yarn, is spooled between an unwinding station and a winding station and passed through a coating unit. In embodiments, relatively constant tension is maintained between the unwinding station and the winding station to maintain uniform movement of the yarn as it passes through the coating unit.

In certain embodiments, the coating unit includes a coater, such as a dip tank or slot die. In specific examples, the coater includes a slot die and the coating agent(s) are passed over the retro-reflective yarn filament as it passed through the slot die. While dip tanks can be used, the slot die is preferred as the amount, thickness, etc. can be more easily controlled with a slot die.

In certain embodiments, the coating unit includes an upstream processing or cleaning unit, which cleans or otherwise prepares the retro-reflective yarn before it enters the coater, such as the slot die. In some examples, the upstream processing unit includes a plasma, which can be include to enhance adhesion of the coating agent on the surface and clean the surface of the filament. The plasma treatment generates free radicals on the surface that helps to enhance adhesion of the coating agent.

Durability of the woven reflective yarn is further enhanced with encapsulation chemistries that do not affect reflectivity but enhance durability to chemicals and abrasion. The encapsulated retro-reflective yarns produced by these methods can be used in the production of fabrics and associated garments as detailed herein. Durability of the reflective garment would be enhanced due to the improved strength of reinforced/plied-reflective tape yarn.

In certain embodiments, the retro-reflective yarn produced is used as a monofilament for incorporation into a fabric. In certain embodiments, the retro-reflective yarn produced is incorporated into a multifilament yarn for incorporation into a fabric, for example a multifilament yarn comprised of multiple single filaments of the retro-reflective yarn or composed of the retro-reflective yarn in conjunction with filaments made from more conventional fibers.

The disclosure is illustrated by the following non-limiting Examples.

EXAMPLES

Example 1

Encapsulation of the Reflective Yarn

Figure 5:
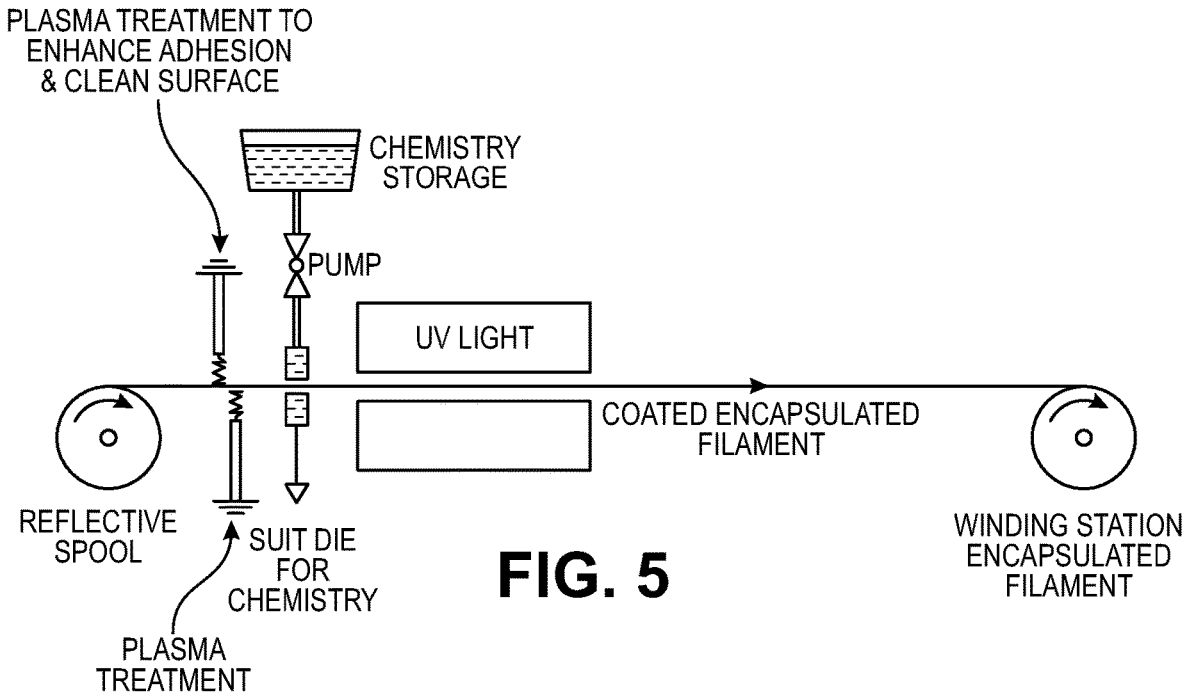
FIG. 5 is a schematic of the retro-reflective yarn coating process.

This example describes exemplary reflective yarn encapsulation processes. The encapsulation process involves coating the raw reflective yarn with one or more coating agents such as functional polyurethanes and/or acrylates, for example, one or more mono, di and/r tri functional polyurethane and/or acrylates, followed by UV and/or IR curing Commercially available reflective yarn e.g., Metlon Retroglo 2P2, HJ Lite HJ9820, Wagner-Tech-Textil Reflexa, etc. is obtained and passed through the coating process and immediately after that a curing process is provided. In the curing process, one is looking to cure either through UV Light or IR heat. A general schematic of this process is shown in FIG. 5. Components of the pressing unit include a winding unit, an unwinding unit, a plasma unit, a slot die and a light source, such as a UV or IR light source. The winding and unwinding units are important to the process to maintain constant tension and uniform movement of the yarn as it passes through the plasma unit, slot die, and the light source. While the plasma unit is omitted in certain applications it can be include to enhance adhesion of the coating agent on the surface and clean the surface of the filament. The plasma treatment generates free radicals on the surface that helps to enhance adhesion.

The slot die is important as it provides much more uniformity in the application of coating agent than where filament is dipped in the agent while travelling. Both methods have been performed.

In the schematic shown, the light source is a UV Light source and is used to cure the coating agent on the yarn. While a UV light source is shown, it is contemplated that an IR, or other light source can be substituted based on the chemistries involved in curing the coating agent. The retro-reflective efficiency of this application can be captured by stressing and comparing (washed vs. unwashed) treated yarns as well as untreated yarns.

Example 2

Durability Assessment and Estimated Performance of Printed/Treated Reflective Fabrics (W/Out Reflective Yarn)

Figure 6:
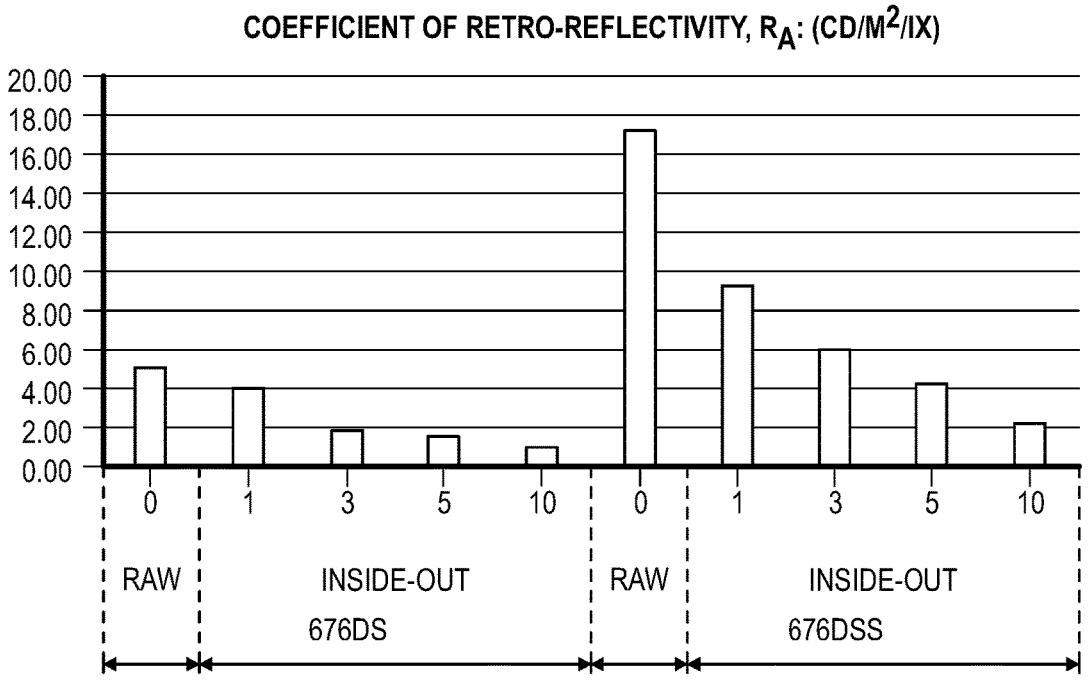
FIG. 6 includes a set of graphs of a fabric with typical finishing, 676DS and un-finished/cleaned-surface fabric, 676DSS.

The durability of un-finished fabrics (or fabrics that undergo pre-treatment/surface cleaning process), was assessed using a retro-reflectometer. As shown in FIG. 6, two denim substrates were treated with the same reflective coating/process. Fabric 1 fabric with typical finishing, 676DS; and fabric 2, un-finished/cleaned-surface fabric, 676DSS. Based on this date it can be concluded that the post-Invisible Print application (Raw—0 home laundries) 676DSS has a higher reflectivity and, therefore, higher retention of glass beads than 676DS. When considering home laundry, the reflective coating is still present after 10 home laundry cycles for 676DSS and barely there for 676DS. For Invisible Print treated fabrics, the retro-reflective performance, i.e. RA value, is anticipated to be between 3 and 25 cd/m$^2$/lx; providing substantial added visibility to user.

Although certain embodiments have been illustrated and described herein, it will be appreciated by those of ordinary skill in the art that a wide variety of alternate and/or equivalent embodiments or implementations calculated to achieve the same purposes is substituted for the embodiments shown and described without departing from the scope. Those with skill in the art will readily appreciate that embodiments is implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A method of making a retro-reflective fabric, comprising:

providing a coated retro-reflective yarn comprising a retro-reflective tape core forming the innermost core of the coated retro-reflective yarn;

incorporating the coated retro-reflective yarn into a weave or a knit of a fabric; and disposing a passive reflective ink into an outward facing surface of the fabric.

2. The method of claim 1, wherein providing coated retro-reflective yarn comprises coating the retro-reflective tape core having retro-reflective elements with a thermoset polymer.

3. The method of claim 2, wherein the thermoset polymer is substantially optically clear.

4. The method of claim 2, wherein the thermoset polymer comprises one or more functional polyurethanes and/or functional acrylates.

5. The method of claim 2, wherein coating the retro-reflective tape core having retro-reflective elements with the thermoset polymer, comprises disposing the thermoset polymer on an outer surface of the retro-reflective tape core and curing the thermoset polymer with light radiation.

6. The method of claim 5, wherein the light radiation comprises one or more of UV light or IR light.

7. The method of claim 6, further comprising cleaning the retro-reflective tape core prior to coating.

8. The method of claim 7, wherein cleaning the retro-reflective tape core, comprises plasma treatment.

9. The method of claim 5, wherein the retro-reflective tape core is coated within a slot die.

10. The method of claim 1, wherein the fabric comprises a woven fabric and with one or more strands of retro-reflective yarn incorporated into a weft and/or a warp of the fabric.

11. The method of claim 1, wherein the fabric comprises a plain weave, a rib weave, a mat weave, a twill weave, a satin weave, or an oxford weave.

12. The method of claim 1, wherein the coated retro-reflective yarn is placed at regular, or irregular positions within the fabric.

13. The method of claim 1, wherein the fabric comprises a denim.

14. A method of making a retro-reflective fabric, comprising:

knitting or weaving a coated retro-reflective yarn into a fabric, the coated retro-reflective yarn comprising a retro-reflective tape core forming the innermost core of the coated retro-reflective yarn; and disposing a passive reflective ink into an outward facing surface of the fabric.

15. The method of claim 14, further comprising coating the retro-reflective tape core having retro-reflective elements with a thermoset polymer to form the coated retro-reflective yarn before knitting or weaving the coated retro-reflective yarn into the fabric.

16. The method of claim 15, wherein coating the retro-reflective tape core with the thermoset polymer includes the thermoset polymer being substantially optically clear.

17. The method of claim 15, wherein coating the retro-reflective tape core with the thermoset polymer includes the thermoset polymer comprising one or more functional polyurethanes and/or functional acrylates.

18. The method of claim 15, wherein coating the retro-reflective tape core having retro-reflective elements with the thermoset polymer further comprises disposing the thermoset polymer on an outer surface of the retro-reflective tape core and curing the thermoset polymer with light radiation.

19. The method of claim 18, wherein curing the thermoset polymer with light radiation includes curing the thermoset polymer with UV light or IR light.

20. The method of claim 19, further comprising cleaning the retro-reflective tape core prior to coating.

21. The method of claim 20, wherein cleaning the retro-reflective tape core, comprises plasma treatment.

22. The method of claim 18, wherein coating the retro-reflective tape core includes coating the retro-reflective tape core within a slot die.

23. The method of claim 14, wherein knitting or weaving the coated retro-reflective yarn into the fabric includes weaving one or more strands of retro-reflective yarn into a weft or a warp of the fabric.

24. The method of claim 14, wherein knitting or weaving the coated retro-reflective yarn into the fabric includes placing the coated retro-reflective yarn regular or irregular positions within the fabric.

* * * * *